US005665670A

United States Patent [19]

Burberry et al.

[11] Patent Number: 5,665,670

[45] Date of Patent: Sep. 9, 1997

[54] RECORDING ELEMENT FOR DIRECT THERMOSENSITIVE PRINTING

[75] Inventors: Mitchell Stewart Burberry, Webster; Bruce Crinean Campbell, Rochester; Daniel Jude Harrison; Elizabeth Vandyke Patton, both of Pittsford, all of N.Y.

[73] Assignee: Eastman Kodak Company, Rochester, N.Y.

[21] Appl. No.: 634,747

[22] Filed: Apr. 16, 1996

[51] Int. Cl.[6] ..... B41M 5/30; B41M 5/32; B41M 5/40

[52] U.S. Cl. ..... 503/201; 503/200; 503/202; 503/211; 503/226

[58] Field of Search ..... 427/152; 503/200, 503/202, 211, 216, 217, 226, 201

[56] References Cited

U.S. PATENT DOCUMENTS 4,247,625 1/1981 Fletcher et al. ..... 430/336
4,857,501 8/1989 Usami et al. ..... 503/200
5,244,861 9/1993 Campbell et al. ..... 503/227

FOREIGN PATENT DOCUMENTS 1-275184 11/1989 Japan .

OTHER PUBLICATIONS

Sturge et al, Imaging Processes and Materials, Neblette's Eighth Edition, pp. 274–275.

*Primary Examiner*—Bruce H. Hess
*Attorney, Agent, or Firm*—Harold E. Cole

[57] ABSTRACT

A thermosensitive recording element comprising a base having coated thereon a thermosensitive recording layer comprising a dye precursor, the base comprising a composite film laminated to at least one side of a support, the thermosensitive recording layer being on the composite film side of the base, and the composite film comprising a microvoided thermoplastic core layer and at least one substantially void-free thermoplastic surface layer.

11 Claims, No Drawings

RECORDING ELEMENT FOR DIRECT THERMOSENSITIVE PRINTING

This invention relates to a recording element for direct thermosensitive printing, and more particularly to a recording element wherein the support is a microvoided composite film.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen.

U.S. Pat. No. 5,244,861 relates a receiving element useful in the above-described thermal dye transfer process which contains a microvoided composite film as the support. There is no disclosure in this patent that the support would be useful in other thermal systems.

Another way to obtain an image generated thermally is to use a so-called "direct-thermal recording element". Such a recording element comprises a support coated with a thermal recording layer which will form a color upon heating.

There is a problem with prior art direct-thermal recording elements in that the density of such recording elements at the mid range is not as good as is desired.

It is an object of this invention to provide a direct-thermal recording element wherein the mid-range density is improved over that of the prior art. It is another object of this invention to provide a process for forming an image using such recording elements.

These and other objects are achieved in accordance with the invention which relates to a thermosensitive recording element comprising a base having coated thereon a thermosensitive recording layer comprising a dye precursor, the base comprising a composite film laminated to at least one side of a support, the thermosensitive recording layer being on the composite film side of the base, and the composite film comprising a microvoided thermoplastic core layer and at least one substantially void-free thermoplastic surface layer.

The thermosensitive recording layer employed in the invention can comprise any of those materials previously used in the art. Such layers generally comprise a dye-precursor dispersed in a binder or in microcapsules. Such dye-precursors include, for example, those materials described in U.S. Pat. No. 4,857,501, the disclosure of which is hereby incorporated by reference, which relates to a thermal recording layer comprising an emulsified dispersion of a color developer and microcapsules containing a colorless or light colored electron donating dye precursor.

Another example of a direct thermal recording layer is described in U.S. Pat. No. 4,247,625, the disclosure of which is hereby incorporated by reference, wherein an imaging element is employed which contains a reaction product of a reducing agent, a cobalt complex and an aromatic dialdehyde to form a dye.

Another example of a direct thermal recording layer comprises a leuco dye compound such as a fluoran, a developer and an electron-accepting compound such as an acid. Still other examples of direct thermal recording layers are described in "Imaging Process and Materials", Neblette's Eighth Edition, Edited by Sturge et al., pages 274–275, and references therein, the disclosure of which is hereby incorporated by reference, such as a microencapsulated diazonium salt dispersed in a binder containing a coupler and a basic compound such as triphenyl guanidine.

A process of forming an image according to the invention comprises imagewise-heating the above direct thermal recording element by means of a thermal head to obtain an image.

Due to their relatively low cost and good appearance, composite films are generally used and referred to in the trade as "packaging films." The support may include cellulose paper, a polymeric film or a synthetic paper.

Unlike synthetic paper materials, microvoided packaging films can be laminated to one side of most supports and still show excellent curl performance. Curl performance can be controlled by the beam strength of the support. As the thickness of a support decreases, so does the beam strength. These films can be laminated on one side of supports of fairly low thickness/beam strength and still exhibit only minimal curl.

Microvoided composite packaging films are conveniently manufactured by coextrusion of the core and surface layers, followed by biaxial orientation, whereby voids are formed around void-initiating material contained in the core layer. Such composite films are disclosed in, for example, U.S. Pat. No. 5,244,861, the disclosure of which is incorporated by reference.

The core of the composite film should be from 15 to 95% of the total thickness of the film, preferably from 30 to 85% of the total thickness. The nonvoided skin(s) should thus be from 5 to 85% of the film, preferably from 15 to 70% of the thickness. The density (specific gravity) of the composite film should be between 0.2 and 1.0 g/cm$^3$, preferably between 0.3 and 0.7 g/cm$^3$. As the core thickness becomes less than 30% or as the specific gravity is increased above 0.7 g/cm$^3$, the composite film starts to lose useful compressibility and thermal insulating properties. As the core thickness is increased above 85% or as the specific gravity becomes less than 0.3 g/cm$^3$, the composite film becomes less manufacturable due to a drop in tensile strength and it becomes more susceptible to physical damage. The total thickness of the composite film can range from 20 to 150 μm, preferably from 30 to 70 μm. Below 30 μm, the microvoided films may not be thick enough to minimize any inherent non-planarity in the support and would be more difficult to manufacture. At thicknesses higher than 70 μm, little improvement in either print uniformity or thermal efficiency is seen, and so there is not much justification for the further increase in cost for extra materials.

Suitable classes of thermoplastic polymers for the core matrix-polymer of the composite film include polyolefins, polyesters, polyamides, polycarbonates, cellulosic esters, polystyrene, polyvinyl resins, polysulfonamides, polyethers, polyimides, poly(vinylidene fluoride), polyurethanes, poly (phenylene sulfides), polytetrafluoroethylene, polyacetals, polysulfonates, polyester ionomers, and polyolefin ionomers. Copolymers and/or mixtures of these polymers can be used.

Suitable polyolefins include polypropylene, polyethylene, polymethylpentene, and mixtures thereof.

Polyolefin copolymers, including copolymers of ethylene and propylene are also useful.

The composite film can be made with skin(s) of the same polymeric material as the core matrix, or it can be made with skin(s) of polymeric composition different from that of the core matrix. For compatibility, an auxiliary layer can be used to promote adhesion of the skin layer to the core.

Addenda may be added to the core matrix to improve the whiteness of these films. This would include any process which is known in the art including adding a white pigment, such as titanium dioxide, barium sulfate, clay, or calcium carbonate. This would also include adding optical brighteners or fluorescing agents which absorb energy in the UV region and emit light largely in the blue region, or other additives which would improve the physical properties of the film or the manufacturability of the film.

Coextrusion, quenching, orienting, and heat setting of these composite films may be effected by any process which is known in the art for producing oriented film, such as by a flat film process or by a bubble or tubular process. The flat film process involves extruding the blend through a slit die and rapidly quenching the extruded web upon a chilled casting drum so that the core matrix polymer component of the film and the skin components(s) are quenched below their glass transition temperatures (Tg). The quenched film is then biaxially oriented by stretching in mutually perpendicular directions at a temperature above the glass transition temperature of the matrix polymers and the skin polymers. The film may be stretched in one direction and then in a second direction or may be simultaneously stretched in both directions. After the film has been stretched it is heat set by heating to a temperature sufficient to crystallize the polymers while restraining the film to some degree against retraction in both directions of stretching.

By having at least one nonvoided skin on the microvoided core, the tensile strength of the film is increased and makes it more manufacturable. It allows the films to be made at wider widths and higher draw ratios than when films are made with all layers voided. Coextruding the layers further simplifies the manufacturing process.

The support to which the microvoided composite films are laminated for the base of the recording element of the invention may be a polymeric, synthetic paper, or cellulose fiber paper support, or laminates thereof.

Preferred cellulose fiber paper supports include those disclosed in U.S. Pat. No. 5,250,496, the disclosure of which is incorporated by reference. When using a cellulose fiber paper support, it is preferable to extrusion laminate the microvoided composite films using a polyolefin resin. During the lamination process, it is desirable to maintain minimal tension of the microvoided packaging film in order to minimize curl in the resulting laminated support. The backside of the paper support (i.e., the side opposite to the microvoided composite film) may also be extrusion coated with a polyolefin resin layer (e.g., from about 10 to 75 g/m$^2$), and may also include a backing layer such as those disclosed in U.S. Pat. Nos. 5,011,814 and 5,096,875, the disclosures of which are incorporated by reference. For high humidity applications (>50% RH), it is desirable to provide a backside resin coverage of from about 30 to about 75 g/m$^2$, more preferably from 35 to 50 g/m$^2$, to keep curl to a minimum.

In one preferred embodiment, in order to produce recording elements with a desirable photographic look and feel, it is preferable to use relatively thick paper supports (e.g., at least 120 μm thick, preferably from 120 to 250 μm thick) and relatively thin microvoided composite packaging films (e.g., less than 50 μm thick, preferably from 20 to 50 μm thick, more preferably from 30 to 50 μm thick).

In another embodiment of the invention, in order to form a recording element which resembles plain paper, e.g. for inclusion in a printed multiple page document, relatively thin paper or polymeric supports (e.g., less than 80 μm, preferably from 25 to 80 μm thick) may be used in combination with relatively thin microvoided composite packaging films (e.g., less than 50 μm thick, preferably from 20 to 50 μm thick, more preferably from 30 to 50 μm thick).

The following example is provided to further illustrate the invention.

EXAMPLE

Preparation of the Microvoided Support—Support A

A commercially available packaging film (OPPalyte® 350 TW, Mobil Chemical Co.) was laminated to a paper support. OPPalyte® 350 TW is a composite film (38 μm thick) (d=0.62) consisting of a microvoided and oriented polypropylene core (approximately 73% of the total film thickness), with a titanium dioxide pigmented, non-microvoided, oriented polypropylene layer on each side; the void-initiating material is poly(butylene terephthalate).

Packaging films may be laminated in a variety of way (by extrusion, pressure, or other means) to a paper support. In the present context, they were extrusion-laminated as described below with pigmented polyolefin onto a paper stock support. The pigmented polyolefin was polyethylene (12 g/m$^2$) containing anatase (titanium dioxide) (12.5% by weight) and a benzoxazole optical brightener (0.05% by weight).

The paper stock support was 137 μm thick and made form a 1:1 blend of Pontiac Maple 51 (a bleached maple hardwood kraft of 0.5 μm length weighted average fiber length), available from Consolidated Pontiac, Inc., and Alpha Hardwood Sulfite (a bleached red-alder hardwood sulfite of 0.69 μm average fiber length), available form Weyerhauser Paper Co. The backside of the paper stock support was coated with high-density polyethylene (30 g/m$^2$).

Preparation of the Non-Microvoided Support—Support B, (Control)

A non-microvoided support was prepared by extrusion-coating a pigmented polyolefin unto a paper stock support. The pigmented polyolefin was polyethylene (12 g/m$^2$) containing anatase (titanium dioxide) (12.5% by weight) and a benzoxazole optical brightener (0.05% by weight). The paper stock support was the same as described above. The backside of the paper stock support was coated with high-density polyethylene (30 g/m$^2$).

Preparation of Direct Thermal Imaging Layer

An imaging element employing a reaction product of a cobalt complex and an aromatic dialdehyde which reacts with ammines generated in response to activating radiation as disclosed in U.S. Pat. No. 4,247,625 was prepared. In the present case, heat is used to excite a thermal reductant which, after activation, reduces a cobaltic ammine complex salt to its cobaltous state. The result of the chain propagating reaction is a polymer having a black color.

Element 1

The following mixture was prepared and stirred until dissolved:

0.4 g cobalt hexaammine trifluoroacetate 1.1 g Compound A (below)

0.45 g 5,5-dimethylhydantoin reducing agent 0.22 g 2-(1-naphthalenyl)-4,6-bis(trichloromethyl)-1,3,5-triazine 4.0 g cellulose acetate propionate 482-20 (20 s viscosity) (Eastman Chemicals Co.)

0.5 g 10% Fluorad FC 431® (a perfluoroamido surfactant from 3M Corp.) in acetone The above solution was coated with 100 μm and 150 μm knives onto paper Support A as described above. After drying, the paper was exposed to heat signals using the thermal printer described below. Reflection densities were measured using an X-Rite Model 820 reflection densitometer (X-Rite Corp., Grandville, Mich.).

Compound A (phthaldehyde derivative)

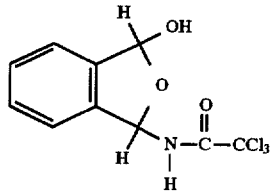

Control 1

This is similar to Element 1 except that Support B was used instead of Support A.

Direct Thermal Printing of an Image

The imaged prints were prepared by placing a slip agent-containing film (to prevent sticking) in contact with the polymeric recording layer side of the recording element. The assemblage was fastened onto a motor-driven 53 mm diameter rubber roller and a TDK Thermal Head L-231, thermostated at 30° C. with a head load of 36 newtons (2 Kg) pressed against the rubber roller. (The TDK L-231 Thermal Print Head has 512 independently addressable heaters with a resolution of 5.4 dots/mm and an active printing width of 95 mm, of average heater resistance 512 Ω.) The imaging electronics were activated and the assemblage was drawn between the print head and roller. The images were printed at 24 volts with a maximum energy level of 362 joules/cm$^2$ and a 1:1 aspect ratio.

A step tablet image was printed. A reflection dye density for each step was measured by using an X-Rite Model 820 reflection densitometer with Status A filters. The reflection density readings were zeroed against each paper support, respectively. The following Table gives a comparison of the reflection densities of a microvoided support recording element versus that of the non-microvoided support recording element for both the 100 μm and 150 μm (wet) thickness of the recording layers:

TABLE

| | | 100 μm Coating | | 150 μm Coating | |
|---|---|---|---|---|---|
| Step | Energy (Joules/cm$^2$) | Element 1 | Control 1 | Element 1 | Control 1 |
| 1 | 362 | 1.93 | 2.07 | 2.16 | 2.23 |
| 2 | 325 | 0.82 | 0.42 | 1.14 | 0.85 |
| 3 | 290 | 0.12 | 0.10 | 0.15 | 0.13 |

TABLE-continued

| | | 100 μm Coating | | 150 μm Coating | |
|---|---|---|---|---|---|
| Step | Energy (Joules/cm$^2$) | Element 1 | Control 1 | Element 1 | Control 1 |
| 4 | 253 | 0.09 | 0.09 | 0.09 | 0.10 |
| 5 | 217 | 0.09 | 0.09 | 0.09 | 0.09 |

The above results show that at the high-energy level of step 1, about the same D-max is achieved for Element 1 and Control 1, indicating that the two were well-matched for solid laydown. The equivalent D-min readings (steps 4–5) are another indication that the solid laydowns of Element 1 and Control 1 were well-matched.

At the mid energy scale (step 2), however, Element 1 yielded significantly higher density than did Control 1, indicating an improved efficiency. This was true for both 100 μm and 150 μm coatings.

The invention has been described in detail with particular reference to preferred embodiments thereof, but it will be understood that variations and modifications can be effected within the spirit and scope of the invention.

What is claimed is:

1. A thermosensitive recording element comprising a base having coated thereon a thermosensitive recording layer comprising a dye precursor, said base comprising a composite film laminated to at least one side of a support, said thermosensitive recording layer being on said composite film side of said base, and said composite film comprising a microvoided thermoplastic core layer and at least one substantially void-free thermoplastic surface layer.

2. The element of claim 1 wherein the thickness of said composite film is from 30 to 70 μm.

3. The element of claim 1 wherein said core layer of said composite film comprises from 30 to 85% of the thickness of said composite film.

4. The element of claim 1 wherein said composite film comprises a microvoided thermoplastic core layer having a substantially void-free thermoplastic surface layer on each side thereof.

5. The element of claim 1 wherein said support comprises paper.

6. The element of claim 5 wherein said paper support is from 120 to 250 μm thick and said composite film is from 30 to 50 μm thick.

7. The element of claim 6 further comprising a polyolefin backing layer on the side of said support opposite to said composite film.

8. The element of claim 1 wherein said thermosensitive recording layer comprises a cobalt complex, an aromatic dialdehyde and a reducing agent.

9. The element of claim 1 wherein said thermosensitive recording layer comprises a leuco dye compound, a developer and an electron-accepting compound.

10. The element of claim 1 wherein said thermosensitive recording layer comprises a diazonium salt, a coupler and a basic compound.

11. A process for forming an image comprising imagewise-heating, by means of a thermal head, the thermosensitive recording element of claim 1.

* * * * *

UNITED STATES PATENT AND TRADEMARK OFFICE

CERTIFICATE OF CORRECTION

PATENT NO. : 5,665,670

DATED : September 9, 1997

INVENTOR(S) : Mitchell S. Burberry, Bruce C. Campbell, Daniel J. Harrison and Elizabeth V. Patton

It is certified that error appears in the above-identified patent and that said Letters Patent is hereby corrected as shown below:

On the title page, after item [22], insert --Related U.S. Application Data [60] Provisional Application Serial No. 60/002,985, filed August 30, 1995.--

In Column 1, line 3, insert --CROSS REFERENCE TO RELATED APPLICATION

Reference is made to and priority claimed from U.S. Provisional Application Serial No. US 60/002,985, filed 30 August 1995, entitled RECORDING ELEMENT FOR DIRECT THERMOSENSITIVE PRINTING--.

Signed and Sealed this

Thirtieth Day of December, 1997

*Attest:*

*Attesting Officer*

BRUCE LEHMAN

*Commissioner of Patents and Trademarks*